United States Patent [19]

Eckold et al.

[11] Patent Number: 5,046,228

[45] Date of Patent: Sep. 10, 1991

[54] TOOL SET FOR CONNECTING SHEET METAL PIECES

[76] Inventors: Gerd-Jurgen Eckold, Silberhutte 11, 3424, St. Andreasberg; Hans Maass, Germelmannstra. 12, 3422, Bad Lauterberg, both of Fed. Rep. of Germany

[21] Appl. No.: 668,727

[22] Filed: Mar. 13, 1991

Related U.S. Application Data

[63] Continuation of Ser. No. 314,007, Feb. 23, 1989, abandoned.

[30] Foreign Application Priority Data

Feb. 24, 1988 [DE] Fed. Rep. of Germany ..... 3805688

[51] Int. Cl.[5] ..... B23P 11/00

[52] U.S. Cl. ..... 29/243.53; 29/243.5; 29/283.5; 29/432

[58] Field of Search ..... 29/238, 243.5, 243.53, 29/283.5, 432, 509, 522.1

[56] References Cited

U.S. PATENT DOCUMENTS

| | | | |
|---|---|---|---|
| 3,995,406 | 12/1976 | Rosman | 29/243.53 |
| 4,459,735 | 7/1984 | Sawdon | 29/243.53 |
| 4,555,100 | 11/1985 | Diotto | 269/283.5 |
| 4,614,017 | 9/1986 | Eckold et al. | 29/432 |
| 4,757,609 | 7/1988 | Sawdon | 29/798 |
| 4,760,634 | 8/1988 | Rapp . | |
| 4,831,704 | 5/1989 | Rapp . | |

FOREIGN PATENT DOCUMENTS

| | | |
|---|---|---|
| 8408792 | 8/1985 | Fed. Rep. of Germany . |
| 3532899 | 3/1987 | Fed. Rep. of Germany . |
| 2189175 | 10/1987 | United Kingdom . |

*Primary Examiner*—J. J. Hartman

*Attorney, Agent, or Firm*—Cushman, Darby & Cushman

[57] ABSTRACT

A tool set including a punch and a die adapted to be mounted respectively on reciprocating press elements. The die includes an anvil and elastically deflectable blades defining, with the anvil, a die cavity of closed contour. The punch contour is smaller than the die contour so that sheet metal pieces to be joined by the tool set are not cut assume a cup-like configuration at the connecting point. The connecting point has an attractive form at both free sides of the sheet metal pieces.

10 Claims, 2 Drawing Sheets

TOOL SET FOR CONNECTING SHEET METAL PIECES

This is a continuation of application Ser. No. 314,007, filed on Feb. 23, 1989, which was abandoned upon the filing hereof.

BACKGROUND AND SUMMARY OF THE INVENTION

The present invention relates to the connection of pieces of sheet metal.

Sheet metal pieces, for example two pieces, are disposed one on top of the other. A punch and a die (hereinafter designated a tool set) are mounted in a press so as to cut, upon actuation of the press, through the superposed sheet metal pieces along two parallel limited cutting lines. Material between these cutting lines is displaced beyond the sheet adjacent the die and compressed between punch and die so that it flows outwards thereby forming an element similar to a rivet head. The cutting elements of the die yield elastically to accommodate the flowing material. The strength of the connection is higher under stress in a direction orthogonal to the cutting lines than parallel thereto. Tool sets to perform such connections are disclosed in European Patent Application 77 932.*

*U.S. Pat. No. 4,614,017.

Another tool set is disclosed in German Published Patent Application 31 06 313.** The die has a closed contour and the punch has a similar contour but of a smaller section so that neither of the sheets is cut and the connection produced is fluid-tight. The die contour is defined by deflecting or yielding elements thereof which are pivotally mounted on a socket. This set of tools, and in particular the die, is somewhat cumbersome and the space required often is not available.

**U.S. Pat. No. 4,459,735.

It is an object of the present invention to provide a tool set for producing fluid-tight sheet metal connections, the die requiring only a minimum space. It is a further object of the present invention to provide a tool set for producing fluid-tight sheet metal connections which exhibit substantially the same strength in all directions.

It is a further object of the present invention to provide a tool set for the purposes set forth above which is of simple design and may be manufactured at reasonably low expense.

According to the invention, the tool set includes a punch and a die to be mounted in a reciprocative press. The die, in turn, comprises an anvil which is stationary, and deflectable blades which may be elastically deflected in a predetermined direction away from the anvil. The die end facing the punch defines a closed contour of a penetration area while the punch contour is smaller than that of the die such that upon press actuation and penetration of the punch through the sheet metals, neither the one adjacent the punch nor the one adjacent the die is cut. According to a first aspect of the invention, the punch contour, when the punch has penetrated the sheet metals, is closer to the die contour seen in the direction in which the die blades may flex than in the direction orthogonal thereto. As a result, the strength of the connection is substantially isotropic in a direction parallel to the sheet faces.

According to another aspect of the invention, the die anvil and the die blades have plane sides facing one another, and the die contour is defined by two end edges of the blades and by a recess provided in the anvil. This permits manufacture of the blades as simple flat members having parallel main faces. Furthermore, the recess in the anvil does not require a complex method of manufacture. The recess in the anvil causes the material to flow in the direction of the elastically yielding blades. As the penetration causes a non-isotropic deformation, the particular design of the die, in turn, causes a non-isotropic flow of the deformed material. As a result, the strength of the connection or joint is uniform in all directions parallel to the sheet faces.

In many applications, as in household appliances, vehicles and the like, the sheet metal piece connections are visible for the user, and for this reason it is desired that the connection exhibits an attractive form, e.g. a shape and contour similar to that of a rivet head. In accordance with the invention, the contours of the punch and the die may be chosen such that the connection, on the punch side, is of a clearly defined oval shape while exhibiting on the die side the form of an approximately circular boss.

The die blades may be provided with suitable coatings so as to increase their edge life and to avoid depositions due to cold welding.

According to the invention, it is particularly advantageous to separate the functions "deformation" and "elastically yielding" of the die blades of the die such that the die blades themselves are not deformed but biased against the anvil by means of leaf springs. This permits the use, for the blades, of a material of extreme strength so as to permit the connection of particularly hard sheet material, as stainless steel. On the other hand, the leaf springs may be made so soft that the die blades yield even under low load, and this makes the tool set suitable for joining thin sheet metals of mild material, as aluminum. It has been found that the tool set of the invention permits joining of a pair of aluminum sheets each having a thickness of not more than 0.2 mm, joining which was not possible hitherto with the tools of prior art.

Further, it is advantageous to support the blades on open half-shell bearings of a socket and to provide therebeneath receptacle spaces for oil, attrition and dust caused by the joining operation.

It is also advantageous to round the joint-defining edges of the blades so as to minimize potential chipping.

Embodiments of the tool set according to the invention are illustrated in the accompanying drawings and will be described in detail hereunder.

DESCRIPTION OF THE PREFERRED EMBODIMENT

Figure 1:
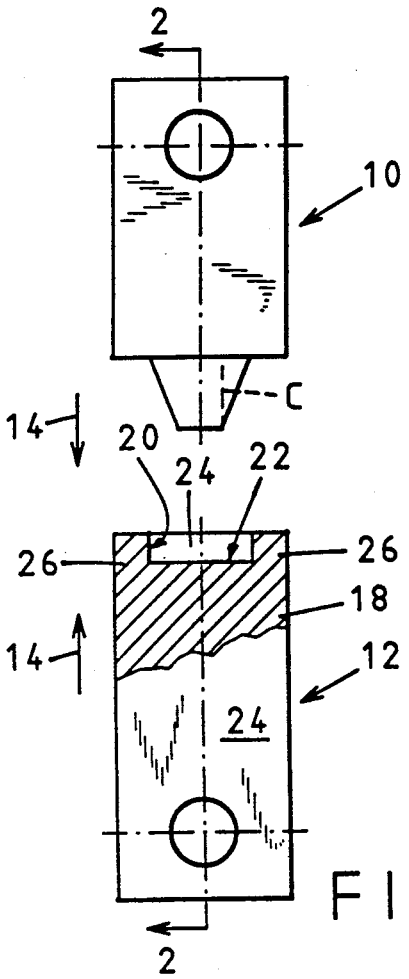
FIG. 1 is a longitudinal section view of the operative parts of a punch and die in a first embodiment.
Figure 2:
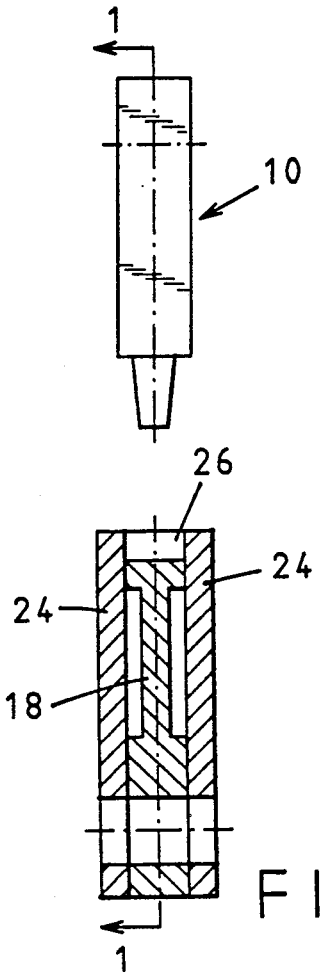
FIG. 2 is a section view according to line 2—2 of FIG. 1, and the section plane 1—1 of FIG. 1 is indicated in FIG. 2.

The tool set of the invention illustrated in FIGS. 1 and 2 comprises a punch 10 and a die 12. Punch 10 and die 12 are designed to be mounted in a press (not shown) so that they may be reciprocated in the direction of arrows 14 thereby connecting or joining two or more sheet metal pieces 16 (FIGS. 3 and 4) held between the punch and die. Die 12 comprises an anvil 18 having a recess 20, the recess bottom being the press surface 22, and two blades 24 which, in this embodiment, are strong leaf springs. Collection spaces 45 are provided for dust, oil, chips, etc. As is readily apparent, upon actuation of the press to perform a stroke, the sheet metal is deformed by the punch into the die cavity defined by the blades 24 and the anvil portions 26 which extend beyond the pressing surface 22. When the movement is limited by the sheet metal material abutting the surface 22, the deformed material flows sidewards because the blades may elastically yield.

Figure 3:
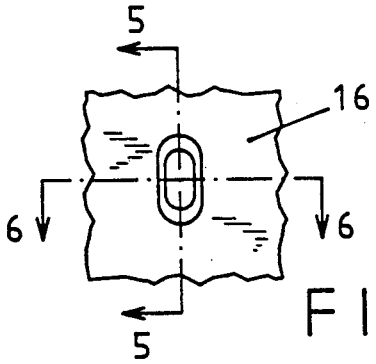
FIG. 3 is a plan view of the punch side of a joint obtained by use of the tool set of the first embodiment, FIG. 4 shown similarly the die side of the connection.
Figure 5:
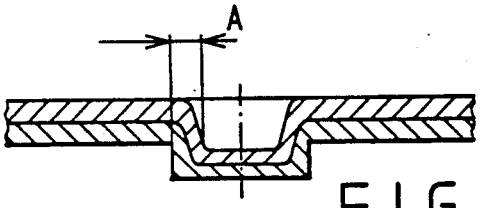
FIGS. 5 and 6 are respectively section views of the connection illustrated in FIGS. 3 and 4 and indicated by lines 5—5 and 6—6, respectively, but at an enlarged scale relative to said figures.
Figure 6:
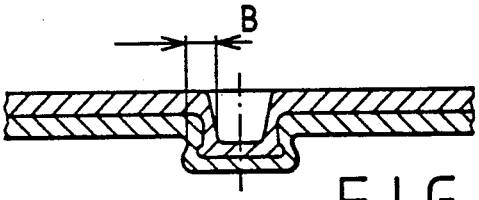
Figure 4:
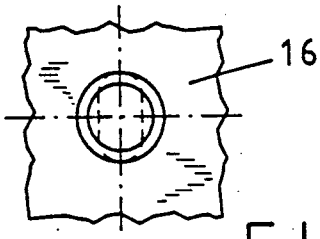
Figure 8:
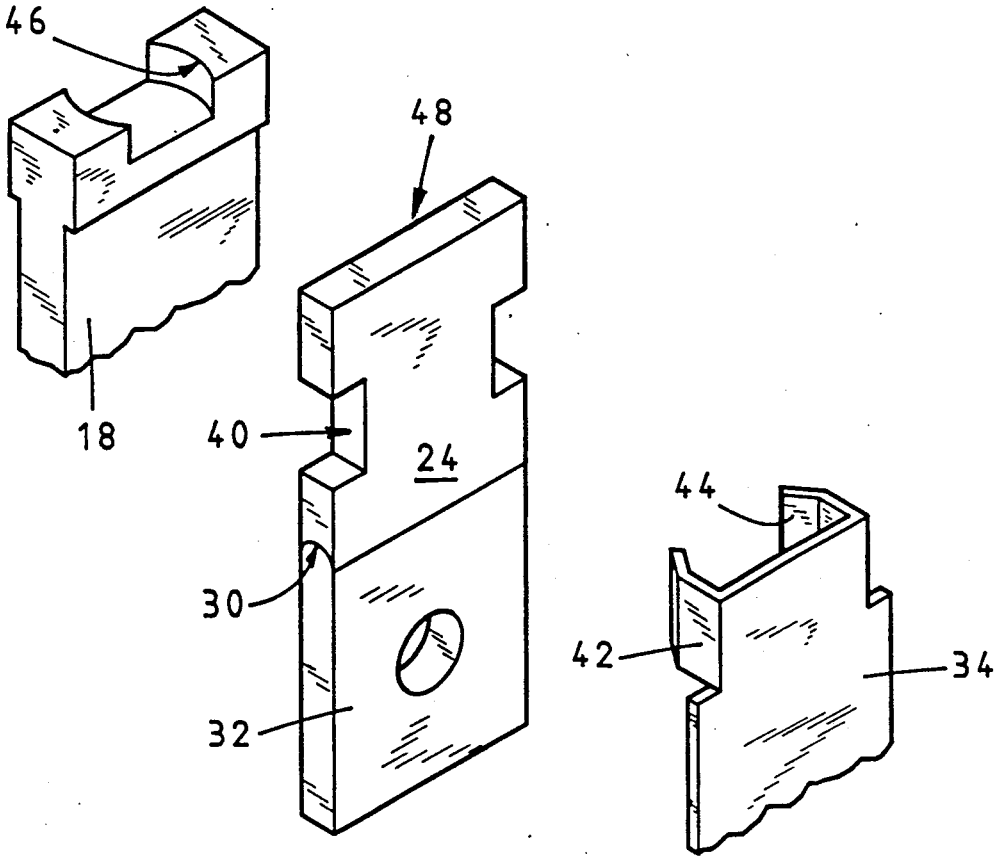
FIG. 8 is an isometric partial explosive illustration of the anvil, one of the blades, and one of the leaf springs of the die shown in FIG. 7.

The punch contour is of oval shape as seen in FIG. 3, and similarly, the contour of the die cavity approaches an oval shape (this is best seen in FIG. 8). The punch contour is recessed with respect to the die cavity contour, e.g., the punch contour is smaller than the die cavity contour, such that during the connecting operation, neither one of the sheets is cut through; consequently, it is readily apparent that a particular set of punch and die is suited for joining particular sheets only having a given thickness and strength. Further, this punch recessing is unequal in the two planes defined by the sections of FIGS. 1 and 2, respectively: the dimension marked "A" in FIG. 5 is substantially larger than dimension "B" in FIG. 6, and this is reflected in the section shape of the joint produced by the tool set; FIGS. 5 and 6 show the attractive appearance of the connection.

The illustration of FIGS. 1 and 2 is somewhat schematic in order to explain the basic concept of the invention. If the die were actually designed as shown in FIGS. 1 and 2, it would have two significant drawbacks: first, a compromise must be reached regarding the strength and elasticity of the blades, and second, chips would probably fall from collection space 45 into the gap between the blades and anvil tending to permanently keep the blades spread apart from the anvil which necessarily results in joints of inferior quality.

Figure 7:
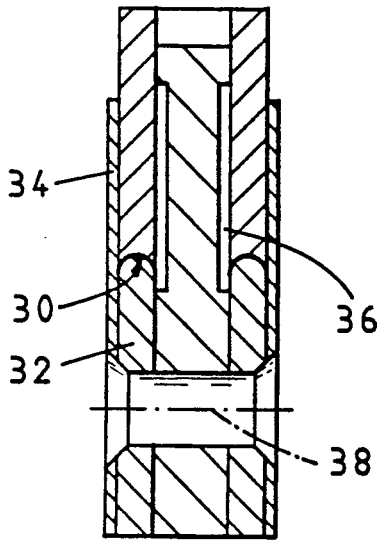
FIG. 7 illustrates similarly to FIG. 2 a die of a second embodiment of the tool set of the invention.

For these reasons, a design as illustrated in FIGS. 7 and 8 is preferred for the die. Each blade 24' is supported on one half-shell or knife-blade bearing 30 of a socket 32 so that the blades can be readily deflected, and the blades 24' are biased against the anvil 18'. Thus, the blades 24' may be made of quite hard material while the biasing leaf springs 34 permit limited, but almost unrestrained, yielding upon flow of the material. The bearings 30, in this embodiment, have an arcuate profile facing the punch so that dust, oil and the like fall down from the bearing surface. The anvil 18', in turn, is inwardly recessed beneath its operating part so as to define collection spaces 45' for such material and for chips produced during the operation; these collection chambers end beneath the bearings 30. Anvil 18', socket 32 and leaf springs 34 may be assembled by a hollow rivet or the like so as to form a uniform die; in FIG. 7, only the axis 38 of such a connecting element is indicated.

In order to maintain the blades on their bearings 30, the blades are provided with lateral notches 40, and bent tongues 42 of the respective leaf spring engage thereinto. The free ends of tongues 42 have angled extensions 44 which positively secure the respective blade. In the rest position of the die, these extensions find accommodation in the anvil recesses mentioned above.

Formation of chips may be substantially decreased or even eliminated if the edges 46 of anvil 18' and the edges 48 of the blades are rounded.

Figure 9:
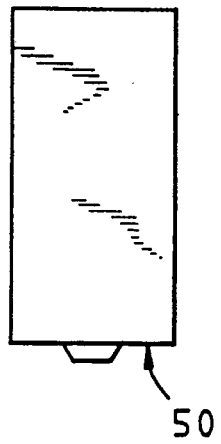
FIG. 9 shows an alternative punch design in side view.

FIG. 9 shows a punch shape where the penetration depth of the punch is limited by a shoulder 50 which engages the free surface of the punchside sheet metal piece. This punch design is preferred when the tool set is provided for thin and weak sheets so as to avoid "climbing up" of the dislocated material. Further, the press need not have a stroke limiter but only a force limiter, a feature which may be advantageous in hydraulically driven presses.

We claim:

1. A tool set adapted to be mounted in a reciprocative press for connecting sheet metal pieces, the tool set comprising:

a punch, a die comprising an anvil in which a cavity is defined by a contour having a lower end press surface and at least two pairs of opposing sides, means to limit flow of deformed material including one of said pairs of opposing sides being defined by fixed upstanding anvil portions, said upstanding anvil portions extending upwardly from said lower end press surface, said press surface comprising a lower end of said cavity contour, and means to allow flow of deformed material including another pair of opposing sides defined by blades, said blades being positioned opposing one another adjacent said upstanding anvil portions when said blades are in a first position, means to bias said blades toward said first position, each of said blades having a free end and an opposite end, said opposite end being pivotally mounted adjacent said anvil, said blades being elastically deflectable away from said first position toward a second position when said punch penetrates into said sheet metal pieces and into said die cavity, said punch having an exterior contour smaller than said die cavity contour, said punch contour being spaced at least a first and a second distance from said die cavity contour, said first distance in a first plane of symmetry extending in a first direction towards said blades and a second distance in a second plane of symmetry extending orthogonally to said first plane in a second direction, said first distance being smaller than said second distance when said blades are in said first position, said punch contour being sufficiently spaced from said die contour to prevent cutting of said sheet metal pieces when said punch penetrates into said sheet metal pieces and into said die cavity.

such that said sheet metal pieces flow non-isotropically toward said elastically yielding blades when said punch penetrates into said sheet metal pieces and into said die cavity so as to produce a sheet metal connection which exhibits substantially isotropic strength when subjected to stress in a direction substantially parallel to said sheet metal pieces.

2. The tool set of claim 1 wherein said anvil and said blades have mating surfaces extending substantially parallel to a direction of reciprocation.

3. The tool set of claim 1 wherein said punch contour is substantially oval in cross-section and said contour of said punch is determined by the thickness and strength of the sheet metal pieces such that when said punch penetrates into said sheet metal pieces the connection formed between the sheet metal pieces comprises a substantially circular boss on a sheet metal piece adjacent the die cavity.

4. The tool set of claim 1 wherein each of said blades are pivotally supported by a bearing of a socket against said anvil by spring means.

5. The tool set of claim 4 wherein said spring means comprise leaf springs.

6. The tool set of claim 4 wherein said bearing is a knife-blade bearing.

7. The tool set of claim 1 further comprising debris collection spaces defined by said blades and said anvil.

8. The tool set of claim 1 wherein a die cavity side top edge of said free end of each of said blades is rounded.

9. The tool set of claim 1 wherein said blades have a wear-reducing coating.

10. The tool set of claim 1 wherein the depth of said punch contour is less than the depth of said die cavity.

* * * * *